US012241656B2

(12) United States Patent
Wardrop et al.

(10) Patent No.: US 12,241,656 B2
(45) Date of Patent: Mar. 4, 2025

(54) HYBRID RESIDENTIAL HEATER AND CONTROL SYSTEM THEREFOR

(71) Applicant: FLEXCHANGER TECHNOLOGIES INC., Vancouver (CA)

(72) Inventors: Walter Wardrop, Vancouver (CA); Nicholas Barber, Mission (CA)

(73) Assignee: Flexchanger Technologies, Inc. (CA)

( * ) Notice: Subject to any disclaimer, the term of this patent is extended or adjusted under 35 U.S.C. 154(b) by 0 days.

(21) Appl. No.: 17/760,748

(22) PCT Filed: Sep. 17, 2020

(86) PCT No.: PCT/CA2020/051249

§ 371 (c)(1),
(2) Date: Mar. 15, 2022

(87) PCT Pub. No.: WO2021/051199

PCT Pub. Date: Mar. 25, 2021

(65) Prior Publication Data

US 2024/0027102 A1 Jan. 25, 2024

(30) Foreign Application Priority Data

Sep. 17, 2019 (CA) ..... CA 3056048

(51) Int. Cl.
*F24H 15/16* (2022.01)
*F24H 3/12* (2022.01)
(Continued)

(52) U.S. Cl.
CPC ..... *F24H 9/2064* (2013.01); *F24H 3/12* (2013.01); *F24H 15/16* (2022.01); *F24H 15/20* (2022.01);
(Continued)

(58) Field of Classification Search
USPC ..... 237/55
See application file for complete search history.

(56) References Cited

U.S. PATENT DOCUMENTS 2,471,351 A 5/1949 Russell
6,222,163 B1 * 4/2001 Arntz ..... F24C 1/04 126/39 BA
(Continued)

FOREIGN PATENT DOCUMENTS

CA 3016944 3/2020
EP 2657619 10/2013

OTHER PUBLICATIONS

WIPO International Search Report, PCT/CA2020/051249, Dec. 10, 2020, 3 pp.
(Continued)

*Primary Examiner* — Steven B McAllister
*Assistant Examiner* — John E Bargero
(74) *Attorney, Agent, or Firm* — Baumgartner Patent Law LLC; Marc Baumgartner

(57) ABSTRACT

A hybrid heating system for use with a gas supply and an electricity supply to provide a temperature controlled environment is provided, the hybrid heating system comprising: a hybrid heater, the hybrid heater including a firebox, a gas burner housed in the firebox and providing a first heat source, a variable pressure gas valve in fluid communication with the gas burner, a modulating actuator in mechanical communication with the variable pressure gas valve, a housing attached to the firebox, an electric element housed in the housing, the electric element providing a second heat source, a high duty cycle on off switch in electrical communication with the electric element; a printed circuit board in electrical communication with the modulating actuator and the high duty cycle on off switch; and a microprocessor
(Continued)

which is in electronic communication with both the modulating actuator and the high duty cycle on off switch.

17 Claims, 13 Drawing Sheets

(51) Int. Cl.

| | |
|---|---|
| ***F24H 9/20*** | (2022.01) |
| ***F24H 15/20*** | (2022.01) |
| ***F24H 15/254*** | (2022.01) |
| ***F24H 15/277*** | (2022.01) |
| ***F24H 15/281*** | (2022.01) |
| ***F24H 15/31*** | (2022.01) |
| ***F24H 15/36*** | (2022.01) |
| ***F24H 15/37*** | (2022.01) |
| ***F24H 15/407*** | (2022.01) |
| ***F24H 15/429*** | (2022.01) |
| ***F24H 15/45*** | (2022.01) |
| *F24C 1/02* | (2021.01) |

(52) U.S. Cl.

CPC ..... *F24H 15/254* (2022.01); *F24H 15/277* (2022.01); *F24H 15/281* (2022.01); *F24H 15/31* (2022.01); *F24H 15/36* (2022.01); *F24H 15/37* (2022.01); *F24H 15/407* (2022.01); *F24H 15/429* (2022.01); *F24H 15/45* (2022.01); *F24C 1/02* (2013.01)

(56) References Cited

U.S. PATENT DOCUMENTS

| | | | | |
|---|---|---|---|---|
| 7,838,803 | B1 * | 11/2010 | Rosen | H05B 1/02 236/1 C |
| 9,970,665 | B2 | 5/2018 | Bush | |
| 10,006,162 | B2 | 6/2018 | Schaben | |
| 2004/0151480 | A1 | 8/2004 | Ito | |
| 2008/0023564 | A1 | 1/2008 | Hall | |
| 2010/0001087 | A1 | 1/2010 | Gum | |
| 2012/0145693 | A1 | 6/2012 | Deng | |
| 2013/0152673 | A1 * | 6/2013 | Young | F23N 1/002 73/40.7 |
| 2021/0270462 | A1 * | 9/2021 | Barber | F24B 7/025 |

OTHER PUBLICATIONS

WIPO Written Opinion of the International Searching Authority, PCT/CA2020/051249, Dec. 10, 2020, 3 pp.

* cited by examiner

HYBRID RESIDENTIAL HEATER AND CONTROL SYSTEM THEREFOR

CROSS REFERENCE TO RELATED APPLICATIONS

This application is a U.S. national phase of International Application No. PCT/CA2020/051249, filed Sep. 17, 2020, which claims priority to Canadian Patent Application Serial No. 3056048, filed Sep. 17, 2019, both entitled HYBRID RESIDENTIAL HEATER AND CONTROL SYSTEM THEREFOR. The above-identified priority patent applications are incorporated herein by reference in their entirety.

FIELD

The present technology is directed to a non-industrial fireplace, stove or furnace that heats or cools the ambient environment in a highly regulated manner using a combination of gas and electricity. More specifically, it is a hybrid heating appliance in which sources of heat can be modulated and the air can be cleaned.

BACKGROUND

The concept of a hybrid fireplace has been around for a long time. For example, U.S. Pat. No. 2,471,351 (granted in 1949) discloses dual hot air heating systems for homes or other enclosures of the general type in which a primary heater, such as an oil or gas burner, is associated with an auxiliary heater, such as a wood-burning or coal-burning fireplace, in a manner such that the heaters may be operated either independently or conjointly to heat the air circulated within the enclosure.

U.S. Pat. No. 10,006,162 discloses a clothes dryer that relies on a hybrid heat source for drying clothes. In some embodiments, the clothes dryer may rely on a combination of electrical energy to power the clothes dryer and hydronic heat to dry clothes. The hydronic heat may, for example, use hot water from an outdoor wood boiler circulated into a hydronic coil. Air passing over the hydronic coil may be warmed and delivered to the clothes dryer. The hybrid heat clothes dryer may reduce energy consumption from about 27 amperes to about 3 amperes. The clothes dryer turns the electric heat on or off in response to a signal from a temperature sensor. The signal is either in response to the temperature falling below a predefined set point or above a predefined set point, hence it is an on/off control. There is no capability to accurately maintain the ambient temperature nor is there the capability to modulate the heat source in relation to response to a user's preference, nor is there the capability of the heat source provider (the utilities company) to control the usage of their heat source. Further, there is no capability to accurately adjust the amount of gas being burned.

U.S. Pat. No. 9,970,665 discloses a heat pump system with a hybrid heating system. The heat pump system includes a first housing comprising a heat exchanger, a compressor, and a fan. The heat pump system also includes a second housing that includes a supplemental heat source that is activated when the outside air falls below a certain temperature. The second housing includes a series of dampers that permit recirculation of the air passing through the first housing so that the supplemental heat source can provide heat to the recirculated air. The supplemental heat source increases the heating capacity of the heat pump system. A controller is disclosed that can turn the supplemental heat source on and off in response to the temperature falling below a predefined set point or above a predefined set point. It is also disclosed that the controller can modulate the supplemental heat source by using a temperature actuated valve to adjust an input. The input is in response to the temperature falling below a predefined set point or above a predefined set point, hence it is an on/off control. There is no capability to accurately maintain the ambient temperature nor is there the capability to modulate the heat source in relation to response to a user's preference, nor is there the capability of the heat source provider (the utilities company) to control the usage of their heat source. Further, there is no capability to accurately adjust the amount of gas being burned.

United States Patent Application 20120145693 discloses a heating apparatus can be a dual heating power source or a hybrid heater. For example, the heating apparatus can include a fuel delivery system for combusting a gas fuel and a separate electronic heater. Other types of heating sources or methods can also be used to provide the heating apparatus with more than one heating source and/or heating method. The heating apparatus can also include one or more air flow channel to facilitate efficient heating of air flow through the heating apparatus. The heating apparatus can be connected to a control or feedback system, which is disclosed as a thermostat thus a switching a heater on or off is in response to the temperature falling below a predefined set point or above a predefined set point. In other words, it is an on/off control. There is no capability to accurately maintain the ambient temperature nor is there the capability to modulate the heat source in relation to response to a user's preference, nor is there the capability of the heat source provider (the utilities company) to control the usage of their heat source. Further, there is no capability to accurately adjust the amount of gas being burned.

United States Patent Application 20040151480 discloses electric heaters and combustion heaters constituting a hybrid type hot-air heater wherein both heaters are equipped with inlets adjacent to each other and are also housed within a frame and separated such that the air blowing systems of each heater are independent of each other, air leakage will occur in only the combustion heater during the heating operation in a direction opposite to the air blowing passage of the electric heater thereby resulting in dust adhering to the electric heater. If the electric heater is operated in this state, the dust will be heated and then burn causing a foul odor to occur when the heating operation first starts. Therefore, the air blowing fan 43 runs to remove any dust that entered into the air blowing passage before the electric heater 4 runs when the electric heater unit 4, equipped with an electric heater 44, is performing a heating operation. Temperature control is by way of an on/off switch. There is no capability to accurately maintain the ambient temperature nor is there the capability to modulate the heat source in relation to response to a user's preference, nor is there the capability of the heat source provider (the utilities company) to control the usage of their heat source. Further, there is no capability to accurately adjust the amount of gas being burned.

EP2657619 discloses a method and apparatus for controlling a hybrid heating and ventilation system of a building, the system comprising a heating and ventilation apparatus (2), solar collectors (3), main energy storage and preheating storage units (14, 15), a heat accumulator (4) and a central control unit (1) for the system. The invention is characterized in that solar energy is utilized in four different ways, i.e. once propylene glycol circulating in the solar collectors (3) has attained the temperature of +8° C., the thermal energy thereof is used to heat air feed introduced into the heating and ventilation apparatus (2), once propylene glycol is at about +30° C., the thermal energy thereof is utilized to heat the preheating storage unit (15), once propylene glycol is at a temperature of more than +60° C., the thermal energy thereof is utilized to heat the main storage unit (14), and once each storage unit (14, 15) has attained the temperature of +80° C., thermal energy of propylene glycol is passed to a heat accumulator (4) arranged under the building to be utilized for heating incoming air during winter season. There is no capability to accurately maintain the ambient temperature nor is there the capability to modulate the heat source in relation to response to a user's preference, nor is there the capability of the heat source provider (the utilities company) to control the usage of their heat source. Further, there is no capability to accurately adjust the amount of gas being burned.

United States Patent Application 20080023564 discloses a method and apparatus for centrally controlling a hybrid furnace, heater, and boiler system installation which increases the operational cost efficiency of the hybrid installation by computing the operational efficiency and fuel costs of the individual furnace(s), heater(s), and boiler(s) and signaling the most advantageous choice. The apparatus may further embody thermostatic control functions. This system is for industrial settings that have multiple furnaces, heaters and/or boiler systems and not an integrated dual heating system. Use of a given heat source is controlled by on/off switches. There is no capability to accurately maintain the ambient temperature.

What is needed is an efficient hybrid heating system for non-industrial use. The system would preferably include a natural gas or propane fireplace, furnace or stove with a heat exchanger, at least one radiator, at least one air filtering unit and at least one electric element. It would be further preferable if it included an evaporator. In some embodiments it would be preferable if it included a vapor absorption refrigeration unit. It would be preferable if it included a microcontroller for selective control of the heat source, channeling of the heat from the system and cooling of the system.

SUMMARY

The present technology is an efficient hybrid heating system for non-industrial use. The system includes a natural gas or propane fireplace, furnace or stove with a heat exchanger, at least one radiator, at least one air filtering unit and at least one electric element. It also includes an evaporator. In some embodiments it includes a vapor absorption refrigeration unit. The system includes a microcontroller for selective control of the heat source, channeling of the heat from the system and cooling of the system. The microcontroller modulates the heat source used based on parameters including one or more of target temperature, current system load, cost of the heat source, and availability of the heat source. The selection of the heat source and the modulation of the heat source is automatic and therefore requires no human intervention. The accuracy of temperature control is about plus or minus 1° C. (2 degrees F.). The controller can be locally or remotely controlled. The gas or electricity utility is able to request and modulate the power source.

In one embodiment a hybrid heating system is provided for use with a gas supply and an electricity supply to provide a temperature controlled environment, the hybrid heating system comprising: a hybrid heater, the hybrid heater including a firebox, which includes a top, a bottom, a back, a pair of sides, a front, an exhaust flue, a gas burner housed in the firebox and providing a first heat source, a variable pressure gas valve in fluid communication with the gas burner, a modulating actuator in mechanical communication with the variable pressure gas valve, a housing attached to the firebox, the housing including a top, a bottom, a back, a pair of sides, an ambient air inlet proximate the top, an ambient air outlet proximate the bottom, a first ambient air channel in fluid communication with the ambient air inlet, a second ambient air channel; a fan between the first ambient air channel and the second ambient air channel, the second ambient air channel in fluid communication with the first ambient air channel via the fan, a heat exchanger housed in the housing proximate the top of the firebox and in fluid communication with the second ambient air channel, a third ambient air channel in fluid communication with the heat exchanger and the ambient air outlet, an electric element housed in the housing downstream from the heat exchanger, the electric element providing a second heat source, and a high duty cycle on off switch in electrical communication with the electric element; a printed circuit board; and a microprocessor which is in electronic communication with both the modulating actuator and high duty cycle on off switch.

In the hybrid heating system, the first ambient air channel may be defined by a first safety barrier and a second safety barrier on the front of the housing.

In the hybrid heating system, the second ambient air channel may be defined by the second safety barrier and the front.

In the hybrid heating system, the third ambient air channel may be defined by the back of the firebox and the back of the housing.

The hybrid heating system may further comprise a room temperature sensor in wired or wireless communication with the printed circuit board and the microprocessor.

In the hybrid heating system, the microprocessor may be configured to modulate the first heat source and the second heat source based on parameters including one or more of a target temperature, a selected rate of heating, a current system load, a cost of a heat source and an availability of the heat source.

In the hybrid heating system, the microprocessor may be configured to switch the first heat source on and off, switch the second heat source on and off and adjust an output of each of the first heat source and the second heat source.

In the hybrid heating system, the microprocessor may be configured to maintain the target temperature at plus or minus 1° C. or the selected rate of heating at plus or minus 1° C. of a selected temperature at a selected time.

In the hybrid heating system, the high duty cycle on off switch may be configured to cycle at about 30 times a second to about 10,000 times a second.

In the hybrid heating system, the variable pressure gas valve and the modulating actuator may be configured to control a pressure of gas at about 0.1% to about 10% increments.

In the hybrid heating system, one or more of the printed circuit board and the microprocessor may include a wired link or a wireless link.

The hybrid heating system may further comprise a computing device which includes a wired link or a wireless link and is remote to the hybrid heater, the printed circuit board and the microprocessor.

In the hybrid heating system, the computing device may be a personal computing device.

In the hybrid heating system, the personal computing device may be a mobile device.

In the hybrid heating system, the computing device may be a utilities company computing device.

In the hybrid heating system, the computing device may be a third-party systems management company computing device.

In the hybrid heating system, the computing device may include a memory and a processor, the memory configured to instruct the processor to instruct the microprocessor to modulate the first heat source and the second heat source based on parameters including one or more of the target temperature, the selected rate of heating, the current system load, the cost of a heat source and the availability of the heat source.

The hybrid heating system may further comprise a utilities company computing device, which includes a wired link or a wireless link for communication with the personal computing device.

In the hybrid heating system, the utilities company computing device may include a memory and a processor, the memory configured to instruct the processor to determine a cost-effective heating mode and to inform the personal computing device of the cost-effective heating mode.

The hybrid heating system may further comprise a third-party systems management company computing device, which includes a wired link or a wireless link for communication with the personal computing device.

In the hybrid heating system, the third-party systems management company computing device may include a memory and a processor, the memory configured to instruct the processor to determine a cost-effective heating mode and to inform the personal computing device of the cost-effective heating mode.

In the hybrid heating system, the hybrid heater may be a gas fireplace with the electric element.

In the hybrid heating system, the housing may be a heat exchanger.

In the hybrid heating system, the housing may be a heating chamber in which the firebox is housed.

The hybrid heating system may further comprise at least one radiator for communicating with a hot water heater, the radiator located downstream from the heat exchanger.

The hybrid heating system may further comprise a vapour absorption refrigeration unit which is located about the exhaust flue.

The hybrid heating system may further comprise an evaporator for communicating with a heat pump, the evaporator located downstream from the heat exchanger.

In another embodiment, a method of heating a domestic space is provided, the method comprising:

- a user selecting the hybrid heating system of claim described above;
- the user selecting a target temperature; and
- the microcontroller modulating the first heat source and the second heat source based on parameters including a target temperature, a selected rate of heating, a current system load, a cost of a heat source and an availability of the heat source by adjusting the gas flow and the electric current flow.

The method may further comprise the user selecting a rate of heating.

The method may further comprise the microprocessor maintaining the target temperature at plus or minus 1° C. or the selected rate of heating at plus or minus 1° C. of a selected temperature at a selected time.

The method may further comprise a high duty cycle on off switch under control of the microprocessor.

The method may further comprise a modulating actuator under control of the microprocessor actuating a variable pressure gas valve to adjust a pressure of gas in about 0.1% to about 10% increments.

The method may further comprise the microprocessor, in any order and in any number of times, switching the first heat source on and off, switching the second heat source on and off and adjusting an output of each of the first heat source and the second heat source.

The method may further comprise the microprocessor communicating with a remote computing device.

The method may further comprise the remote computing device instructing the microprocessor to modulate the first heat source and the second heat source based on parameters including one or more of the target temperature, the selected rate of heating, the current system load, the cost of a heat source and the availability of the heat source.

The method may further comprise the remote computing device determining a cost-effective heating mode and instructing the microprocessor, the microprocessor adjusting the gas flow and the electric current flow such that the gas fire heater and the electric element are operating in the cost-effective heating mode.

In another embodiment, a hybrid heating system is provided for use with a gas supply and an electricity supply to provide a temperature controlled environment, the hybrid heating system comprising: a hybrid heater, the hybrid heater including a firebox, which includes a top, a bottom, a back, a pair of sides, a front, a gas burner housed in the firebox and providing a first heat source, a variable pressure gas valve in fluid communication with the gas burner, a modulating actuator in mechanical communication with the variable pressure gas valve, a housing attached to the firebox, the housing including a top, a bottom, a back, a pair of sides, an ambient air inlet, an ambient air outlet, a first safety barrier and a second safety barrier, the first safety barrier and the second safety barrier defining a first interstitial space and the second safety barrier and the front defining a second interstitial space, a fan mounted between the first interstitial space and the second interstitial space, the first interstitial space in fluid communication with the ambient air intake and the second interstitial space via the fan, a heat exchanger housed in the housing and located proximate the top of the firebox, a refractory chamber defined by the back of the firebox and the back of the housing, an air flow path extending sequentially from the air intake through the first interstitial space, the second interstitial space, the heat exchanger, the refractory chamber and the ambient air outlet, an electric element housed in the housing downstream from the heat exchanger, the electric element providing a second heat source, and a high duty cycle on off switch in electrical communication with the electric element; a printed circuit board; and a microprocessor which is in electronic communication with both the modulating actuator and the high duty cycle on off switch.

FIGURES

DESCRIPTION

Figure 1:
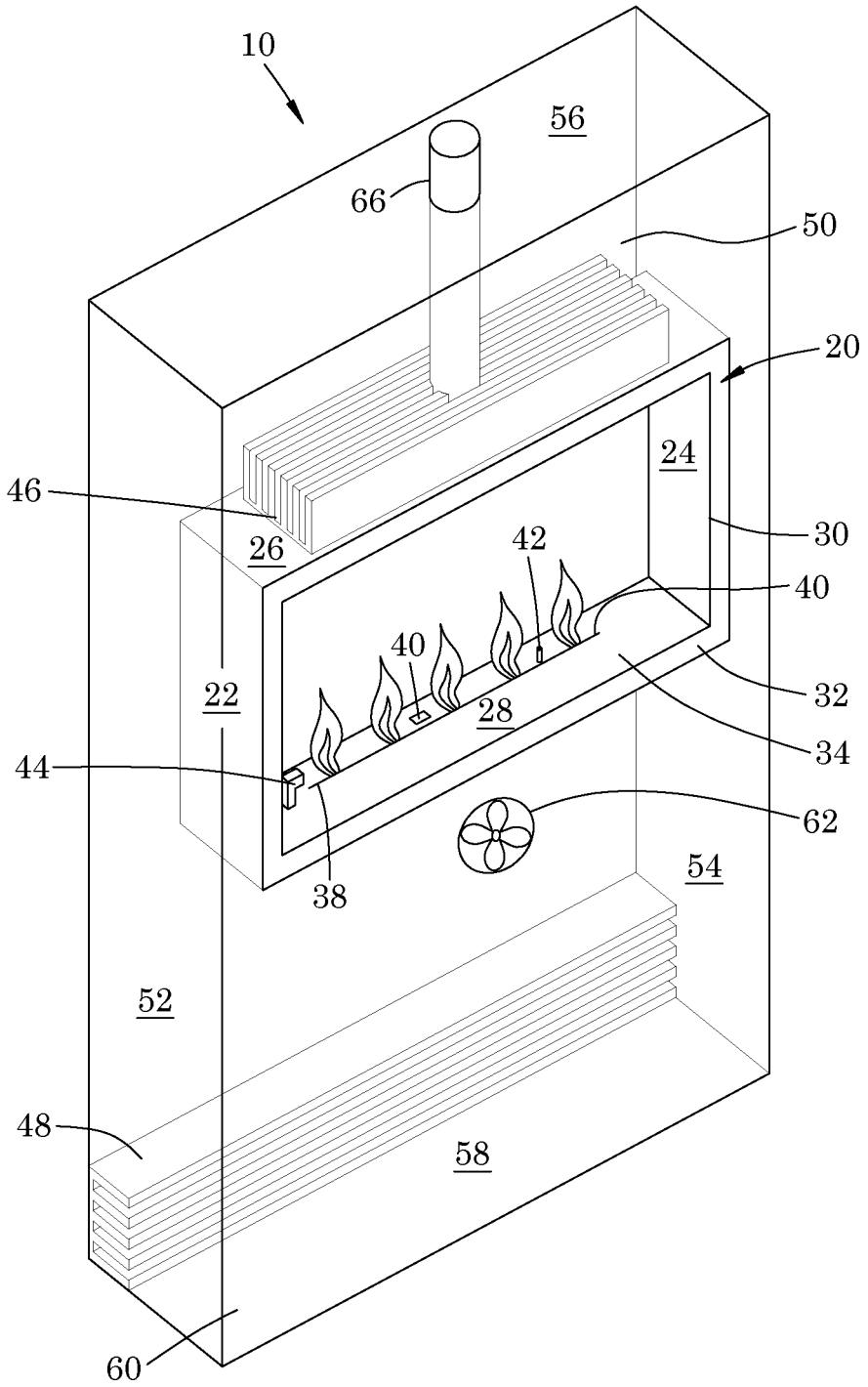
FIG. 1 is a perspective view of the hybrid gas-electricity fireplace of the present technology.

Except as otherwise expressly provided, the following rules of interpretation apply to this specification (written description and claims): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

Definitions

Heat source—in the context of the present technology, a heat source is an electrical power source or a gas source such as propane or natural gas.

Heater—in the context of the present technology, a heater is a fireplace, a stove, a boiler, a furnace or a residential heater, such as a wall heater.

DETAILED DESCRIPTION

Except as otherwise expressly provided, the following rules of interpretation apply to this specification (written description and claims): (a) all words used herein shall be construed to be of such gender or number (singular or plural) as the circumstances require; (b) the singular terms "a", "an", and "the", as used in the specification and the appended claims include plural references unless the context clearly dictates otherwise; (c) the antecedent term "about" applied to a recited range or value denotes an approximation within the deviation in the range or value known or expected in the art from the measurements method; (d) the words "herein", "hereby", "hereof", "hereto", "hereinbefore", and "hereinafter", and words of similar import, refer to this specification in its entirety and not to any particular paragraph, claim or other subdivision, unless otherwise specified; (e) descriptive headings are for convenience only and shall not control or affect the meaning or construction of any part of the specification; and (f) "or" and "any" are not exclusive and "include" and "including" are not limiting. Further, the terms "comprising," "having," "including," and "containing" are to be construed as open-ended terms (i.e., meaning "including, but not limited to,") unless otherwise noted.

Recitation of ranges of values herein are merely intended to serve as a shorthand method of referring individually to each separate value falling within the range, unless otherwise indicated herein, and each separate value is incorporated into the specification as if it were individually recited herein. Where a specific range of values is provided, it is understood that each intervening value, to the tenth of the unit of the lower limit unless the context clearly dictates otherwise, between the upper and lower limit of that range and any other stated or intervening value in that stated range, is included therein. All smaller sub ranges are also included. The upper and lower limits of these smaller ranges are also included therein, subject to any specifically excluded limit in the stated range.

Unless defined otherwise, all technical and scientific terms used herein have the same meaning as commonly understood by one of ordinary skill in the relevant art. Although any methods and materials similar or equivalent to those described herein can also be used, the acceptable methods and materials are now described.

The usage ratio between fuel sources (gas and electricity), may be influenced directly, or indirectly by the occupant, a building management system (BMS), a third party energy management service, or via the utility provider(s), in order to increase operational efficiency, to lower operating costs, and/or to provide building or district wide load management capabilities.

A hybrid gas-electricity fireplace, generally referred to as 10 is shown in FIG. 1. It has a firebox 20 with a first side 22, a second side 24, a top 26, a bottom 28, a back 164 (See FIG. 5) and a front 30, which includes a frame 32 and at least one pane of glass 34. Housed in the interior 36 and located on the floor 38 of the firebox 20 is a gas burner 40. A flame ionization sensing element 42 is beside the gas burner 40. An igniter 44 is located at the gas burner 40 for igniting the gas. A heat exchanger 46 and at least one electrical element 48 is located in a housing 50, which surrounds the firebox 20. The heat exchanger 46 sits on the top 26. The housing 50 includes a first side 52, a second side 54, a top 56, a bottom 58, a back 166 (See FIG. 5) and a front 60. The housing 50 also houses a fan 62. An exhaust flue 66 extends through the top 26 of the firebox 20, the heat exchanger 46 and the top 56 of the housing 50, connecting the interior 36 of the firebox 20 with an ambient environment.

In an alternative embodiment, the housing 50 is attached to the top 26 of the firebox 20 and extends upward therefrom. The exhaust flue 66 extends through the top 26 of the firebox 20 and the top 56 of the housing 50, connecting the interior 36 of the firebox 20 with an ambient environment.

In yet another embodiment, the housing 50 is attached to the bottom 28 of the firebox 20 and extends downward therefrom.

In any embodiment, the fireplace 10 may be double sided hence the back 164 of the firebox 20 and the back 166 of the housing 50 are transparent. In any embodiment, the fireplace 10 may be, for example, but not limited to round, semi-circular, facetted, rectangular, or three-faced.

Figure 2:
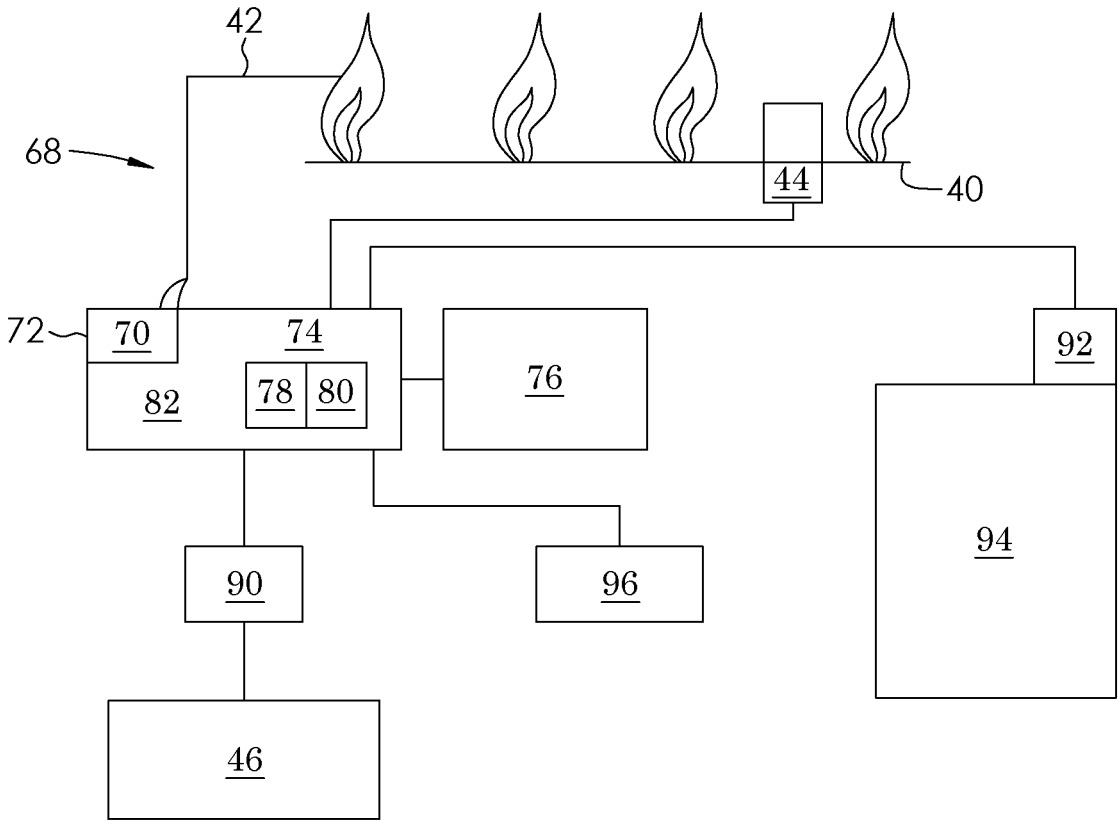
FIG. 2 is a schematic of the flame ionization sensing system of the fireplace of FIG. 1.

As shown in FIG. 2, the flame ionization sensing element 42 or other suitable sensing element such as for example, but not limited to a thermocouple sensor, is part of a flame sensor system 68, which includes a capacitor 70, a printed circuit board 72 and a microprocessor 74 all in electrical communication. A power source 76 powers the flame sensing system 68. The microprocessor 74 includes a memory 78, a processor 80 and a wireless communication link 82, which may be, for example, but not limited to Ethernet, WiFi or a Bluetooth® radio or a wired communication link. The printed circuit board 72 and the microprocessor 74 are also in electrical communication with a high duty cycle on off switch 90 that is in electrical communication with the electrical element 46. The switch 90 cycles between on and off between about 30 times a second to about 10,000 times a second. The on off switch 90 is preferably a bidirectional triode thyristor (TRIAC). Switching is either via pulse-width modulation or phase control.

The printed circuit board 72 and the microprocessor 74 are also in electrical communication with the igniter 44 and an actuator 92, which may be a stepper motor, which in turn is in mechanical communication with a variable pressure gas valve 94. The printed circuit board 72 and the microprocessor 74 are also in wired or wireless communication with a temperature sensor 96 that is located in the room or building that houses the fireplace 10.

Figure 3:
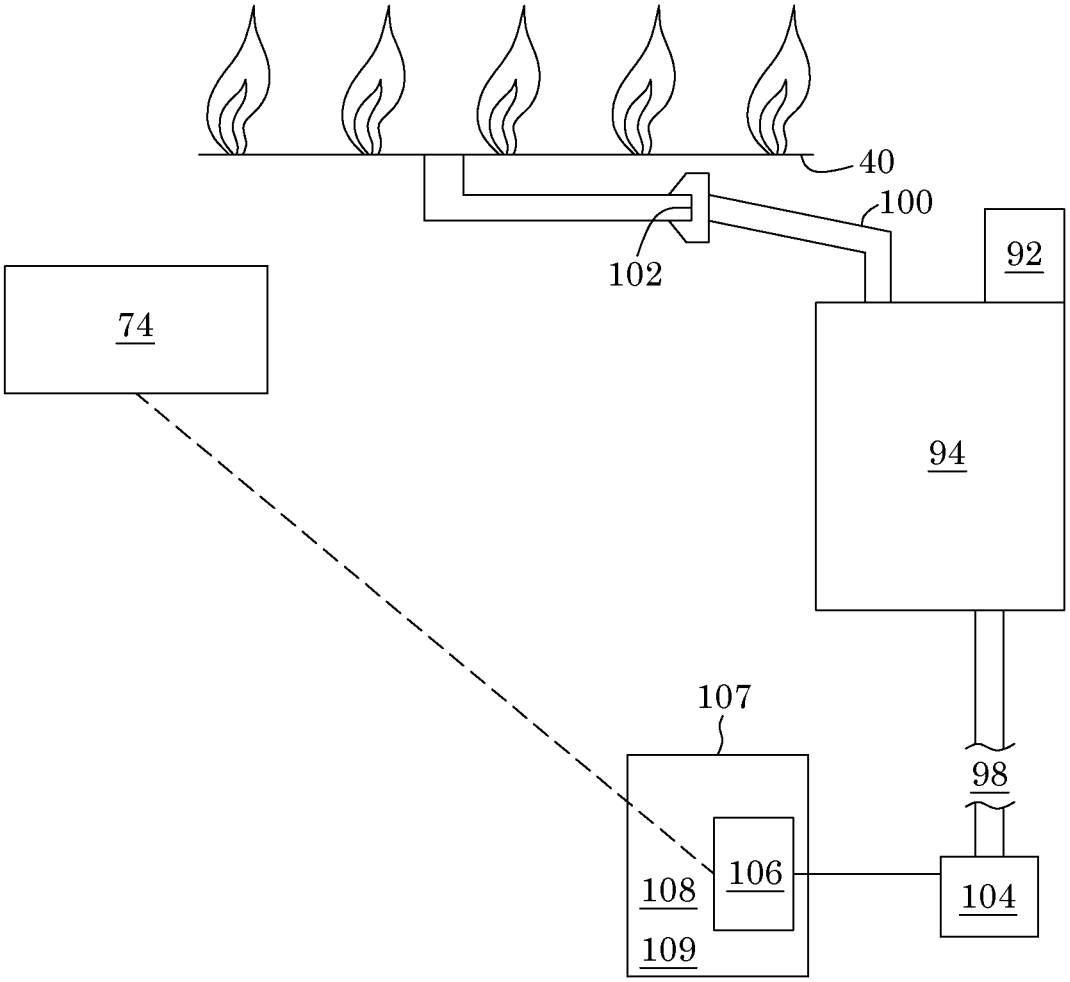
FIG. 3 is a schematic of the gas control system of the fireplace of FIG. 1.

As shown in FIG. 3, the gas valve 94 controls the flow of gas from the main gas supply line 98 through a gas line 100 to a nozzle 102 at the gas burner 40. The main gas supply line 98 is fed from a public gas utility 104. The public gas utility 104 has a wired or a wireless communication link 106, which may be, for example, but not limited to Ethernet, WiFi or a Bluetooth® radio for communicating with the microprocessor 74. The wireless communication link 106 is in a computing device 107, which includes a memory 108 and a processor 109.

If a stepper motor is used as the actuator 92, it can adjust the pressure of the gas at the outlet on the gas valve 94 from about 30% to about 100% in about 0.1% to about 1% increments or about 10% increments. In a preferred embodiment, the modulator 92 is a modulating actuator or a variable position actuator. These may be in communication with a variable current valve 94, which controls the amount of gas and the amount of air being drawn into the gas burner 40. Without being bound to theory, this modulates the thermal output based on feedback from a room temperature sensor 96. This is unlike the prior art in which the gas pressure is in steps of low, medium and high, or has an "on" or "off" setting and is not being modulated in response to the actual room temperature.

Figure 4:
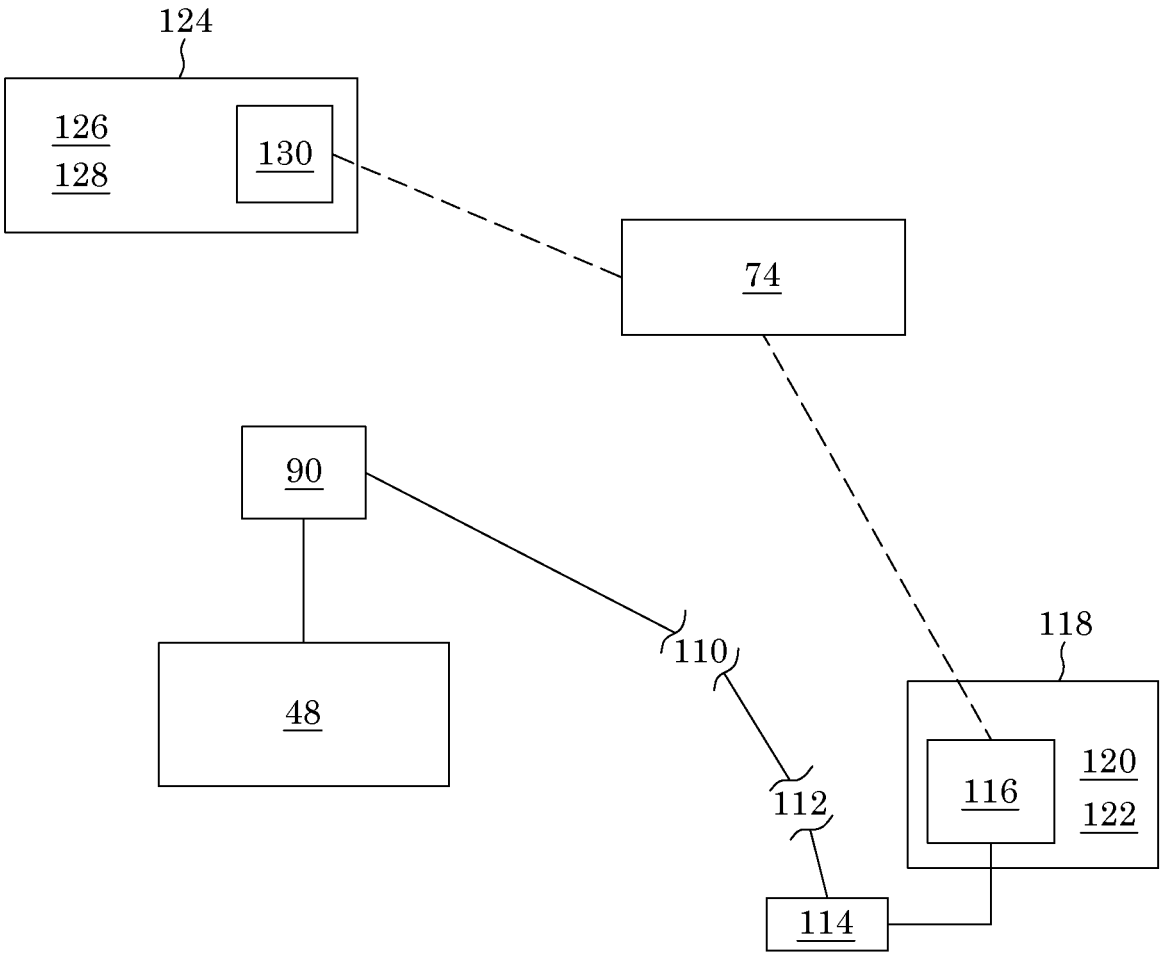
FIG. 4 is a schematic of the electricity control system of the fireplace of FIG. 1.

As shown in FIG. 4, the electrical element 48 is connected to an electrical wire 110, which in turn is connected to a power line 112 from a public power utility 114. The on off switch 90 is located along the electrical wire 110. The public power utility 114 has a wired or wireless communication link 116, which may be Ethernet, WiFi or a Bluetooth® radio for communicating with the microprocessor 74. The wireless communication link 116 is in a computing device 118, which includes a memory 120 and a processor 122.

A user also has a computing device 124 with a memory 126, a processor 128 and a wireless communication link 130. The user's computing device 124 may be a desktop, tablet or a cellular phone or other mobile device, as would be known to one skilled in the art. It communicates with the microprocessor 74.

Figure 5:
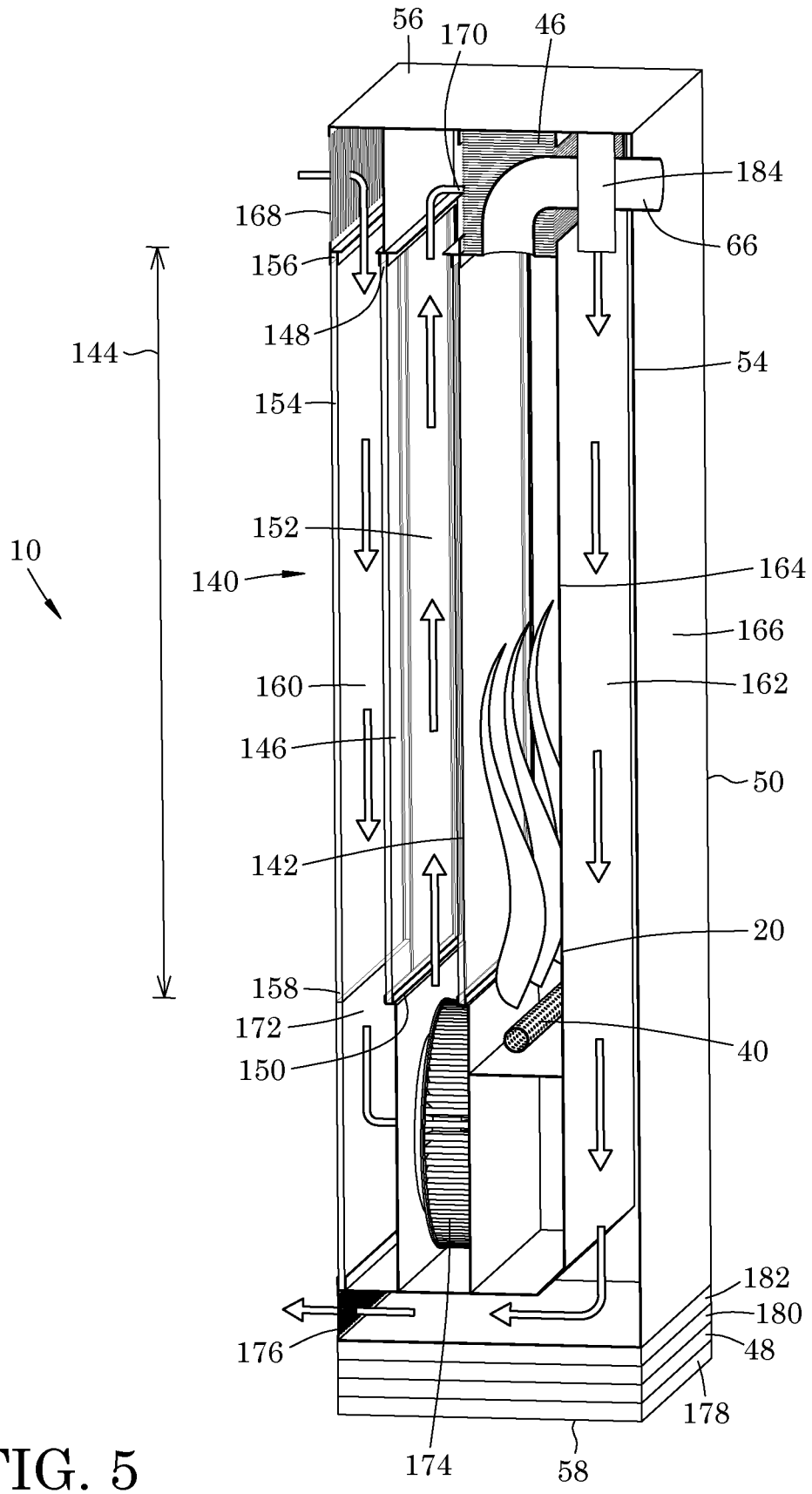
FIG. 5 is a schematic cutaway perspective view of a fireplace of FIG. 1.

As shown in FIG. 5, the fireplace 10 includes a safety barrier heat exchanger, generally referred to as 140 is disposed across the glass panel 142 and viewable opening 144 of the firebox 20. The safety barrier heat exchanger 140 comprises: the housing 50; a first transparent, translucent or opaque safety barrier 154 secured within the housing 50 by upper 148, lower 150 and two opposing side first safety barrier brackets, wherein the first safety barrier 154 is separated from a second safety barrier 146, which may be transparent, by an offset dimension to define a first interstitial space 160 and the second safety barrier 146 is separated from the glass panel 142 of the firebox 50 by an offset dimension to define a second interstitial space 152; the second safety barrier 154 is secured within the housing 50 by upper 156, lower 158 and two opposing side second safety barrier brackets; the fan 62 providing access between the safety barriers 146, 154; a refractory chamber 162 defined by the back 164 of the firebox 20 and the back 166 of the housing 50; at least one ambient air inlet 168 proximate the top 56 of the housing 50 in fluid communication with the first interstitial space 160; at least one exit opening corresponding to the at least one refractory chamber ambient air inlet 170 proximate the top 56 of the housing 50 connecting the second interstitial space 152 and the at least one refractory chamber air inlet 170 in fluid communication; at least one opening 172 proximate the bottom 58 of the housing 50 connecting the first 160 and second 152 interstitial spaces in fluid communication to define a serpentine safety barrier heat exchanger passageway (arrows); and at least one forced air circulating fan or blower 174 secured within the housing 50 and operatively configured to force air through the serpentine safety barrier heat exchanger passageway from the at least one inlet opening 168 to the at least one opening 170, then through the heat exchanger 46 and through the refractory chamber 162, and finally through the at least one refractory chamber ambient air outlet 176. The electrical element 48 is sandwiched between a radiator 178, which is located at the bottom 58 of the housing 50, and an evaporator 180. A second radiator 182 sits on top of the evaporator 180. A vapour absorption refrigerator 184 surrounds the exhaust flue 66.

The flow of ambient air can also be described as through the ambient air inlet 168, through a first ambient air channel (first interstitial space 160), through a second ambient air channel (second interstitial space 152) via the fan 62, through the heat exchanger 46, through a third ambient air channel (refractory chamber 162) and out the ambient air outlet 176.

Figure 6:
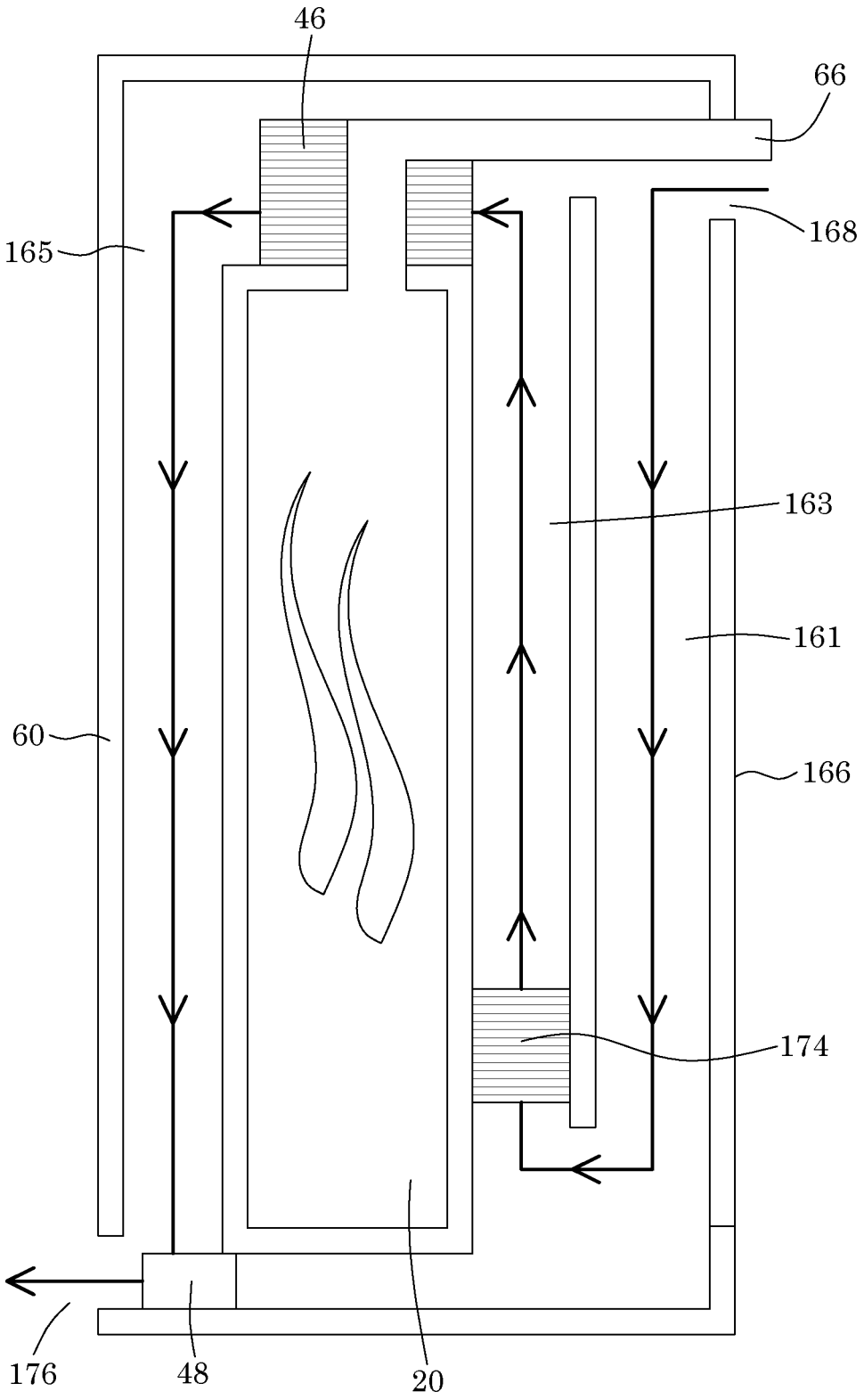
FIG. 6 is a schematic cutaway side view of an alternative embodiment fireplace.

In an alternative embodiment shown in FIG. 6, a first air channel 161 is in fluid communication with the ambient air inlet 168, which is located at the back 166 of the housing 50. The fan 62 connects the first air channel 161 with a second air channel 163. The second air channel 163 connects to a third air channel 165 via the heat exchanger 46. The third air channel 165 is in fluid communication with the ambient air outlet 176. The electrical element 48 is downstream from the heat exchanger 46 and can be located above the firebox 20, beside the firebox 20 or below the firebox 20.

Figure 7:
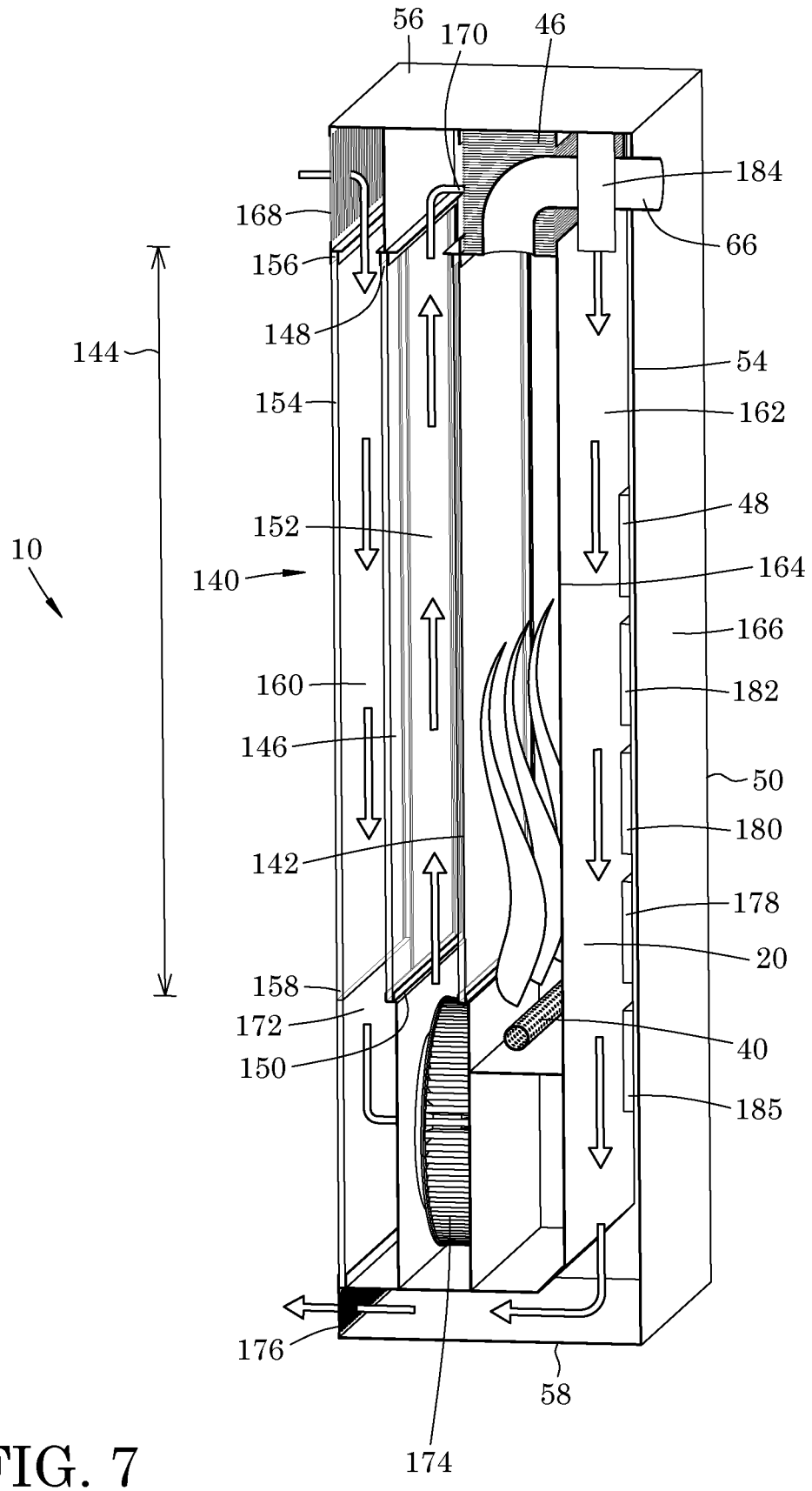
FIG. 7 is a schematic cutaway perspective view of an alternative embodiment fireplace.

In an alternative embodiment shown in FIG. 7, there are at least two electrical elements 48 downstream from the heat exchanger 46. The electrical elements 48 are located in one or more of the refractory chamber 162, the first interstitial space 152 and the second interstitial space 160. They preferably include fins. The radiators 178, 182 and evaporator 180 are similarly be located downstream from the heat exchanger 46 and are in one or more of the refractory chamber 162, the first interstitial space 152 and the second interstitial space 160. The electrical elements 48, the radiators 178, 182 and the evaporator 180 may be in a series or may be stacked. The vapour absorption refrigerator 184 remains proximate the exhaust flue 66. It functions to cool the exhaust, allowing the fireplace 10 to function in a decorative mode in locations where heat is not desired. An air filtration unit 185 is downstream from the heat exchanger 46.

Figure 8:
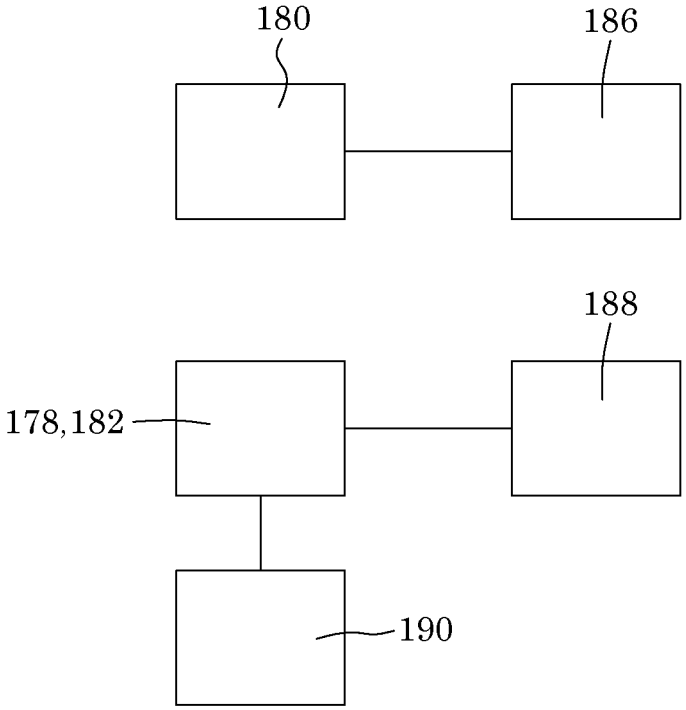
FIG. 8 is a schematic of the system of the present technology.

As shown in FIG. 8, the evaporator 180 is in fluid communication with a heat pump 186 and the radiators 178, 182 are in fluid communication with a hot water tank 188, or a hot water heating system 190 or both.

Figure 9:
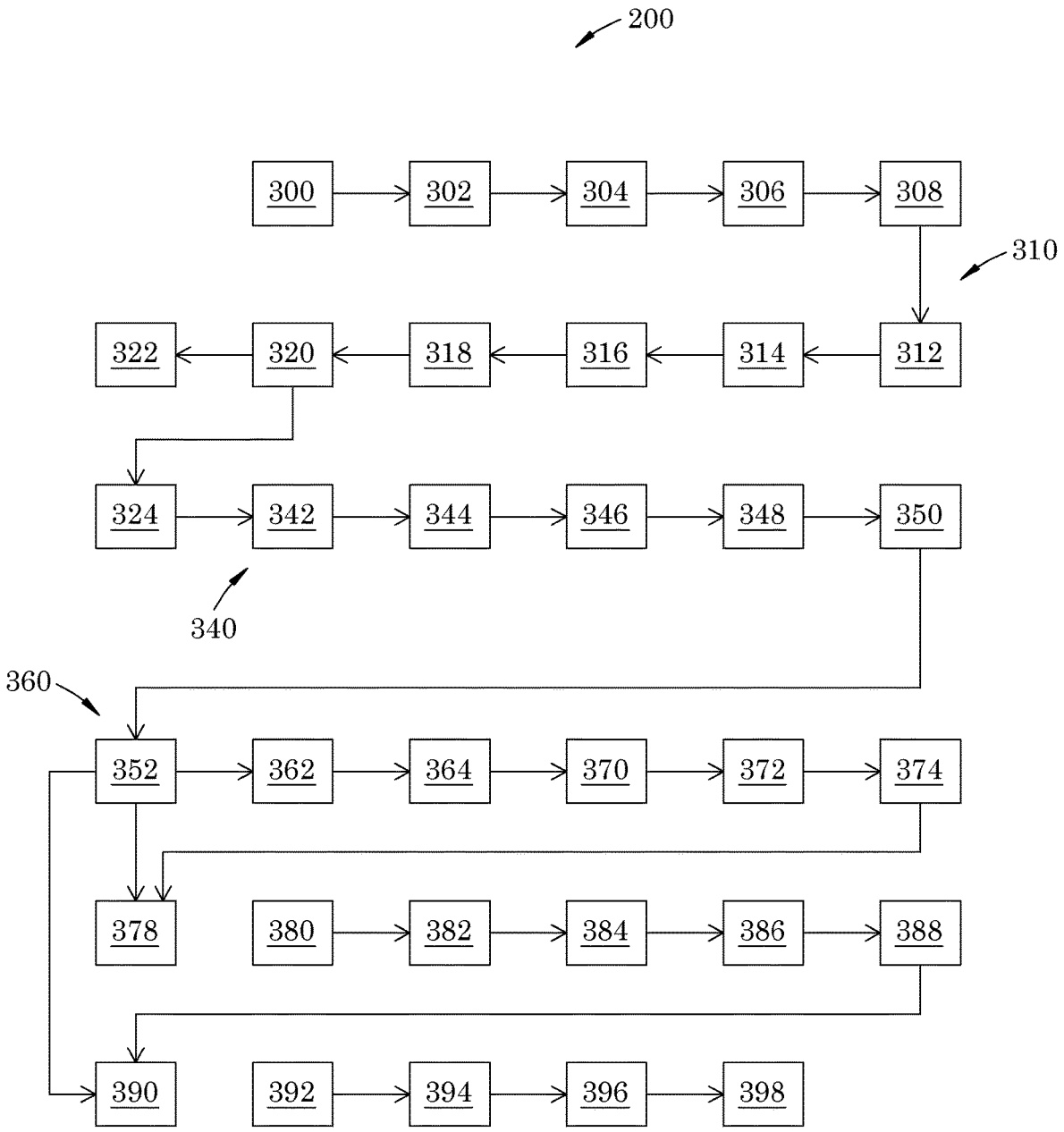
FIG. 9 is block diagram of autonomous operation of the fireplace of FIG. 1.

As shown in FIG. 9, one method of operating the hybrid fireplace is autonomous operation, generally referred to as 200. The temperature is sourced 300 from a remote thermostat or internal thermostat or internal temperature sensor. The desired temperature is set 302 in the microprocessor which is above the ambient temperature. The microprocessor signals 304 the on off switch to switch on the electrical element. The electrical element begins heating 306. This is the electrical heating mode, generally referred to as 310. Once the element (or elements) reaches about 10000 British Thermal Units per hour (BTU/h), by way of example only, or the temperature sensor reports 312 a first selected and predetermined temperature increase to the microprocessor, the microprocessor signals 314 the modulating actuator to open 316 the valve to start the flow of gas and the ignitor to ignite 318 the gas. The microprocessor checks 320 the flame ionization sensor system to confirm that the flame is lit. In one mode the microprocessor signals 322 the electrical switch to shut down power to the electrical element, and the heating appliance runs solely on gas up to the maximum BTU of the gas valve. Alternately, the electric element can be allowed to continue running 324. This is the dual heating mode 340. During this mode, the modulating actuator continues 342 to modulate the gas pressure to modulate the thermal output from the gas burner. This controls the rate of heating, which may be predetermined. Once it reaches about 50,000 BTU/h, by way of example only, or the temperature sensor reports 344 a second selected and predetermined temperature increase to the microprocessor, the microprocessor signals 346 the on off switch to switch off 348 and the electrical element is switched off 350. The microprocessor adjusts 352 the valve to adjust the pressure of the gas at the outlet of the valve. This controls the rate of heating. This is the gas heating mode, generally referred to as 360. Once it reaches about 60,000 BTU/h, by way of example only, or the temperature sensor reports 362 a third selected and predetermined temperature increase to the processor, the microprocessor may select one of three modes—the electrical heating mode 310, the dual heating mode 340 or the gas heating mode 360. Prior to entering the electrical heating mode 310, the gas burner is shut off by the microprocessor signaling 362 the modulating actuator, which then closes 364 the valve. In the electrical heating mode, the temperature sensor continually reports 370 the temperature to the microprocessor which then signals 372 the on off switch to switch 374 In the dual heating mode 340 the temperature sensor continually reports 380 the temperature to the microprocessor which then signals 382 the on off switch to switch 384. The microprocessor also signals 386 the modulating actuator which modulates 388 the gas pressure. Both modulate the thermal output thus maintaining 390 the temperature at a plus or minus 1° C. In the gas heating mode 360, the microprocessor also signals 392 the modulating actuator which modulates 394 the gas pressure, which modulates 396 the thermal output thus maintaining 398 the temperature at a plus or minus 1° C.

Figure 10:
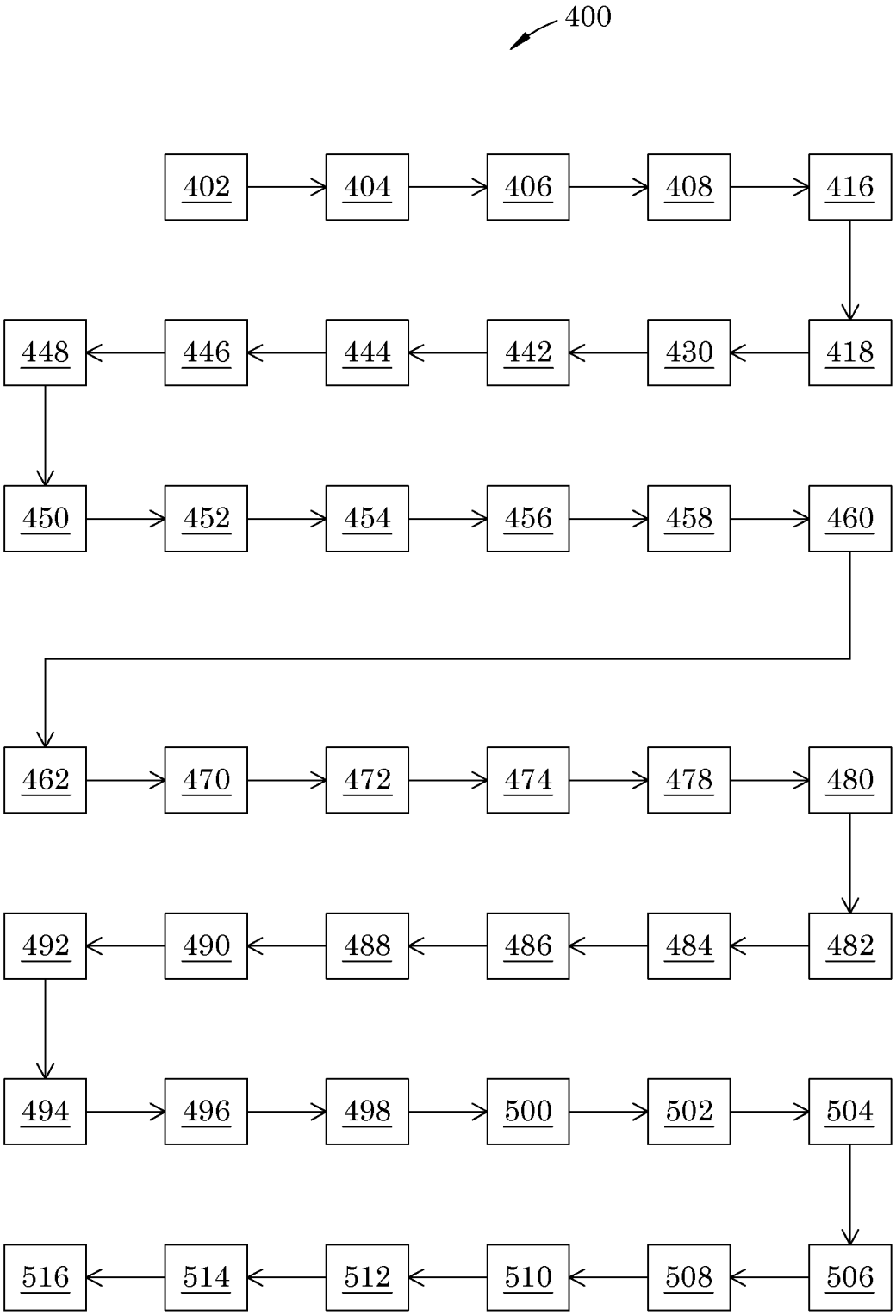
FIG. 10 is a block diagram of ad hoc user-controlled operation of the fireplace of FIG. 1.

As shown in FIG. 10, a second method of operating the hybrid fireplace is an ad hoc user-controlled operation, generally referred to as 400. In this, the user selects 402 the temperature and the heat source. The user may, for example, instruct 404 their mobile device, which then sends 406 a wireless message to the wireless link of the microprocessor to heat using gas first or alternatively sends a wired message to a desktop. The microprocessor signals 408 the modulating actuator to open 416 the valve to start the flow of gas and the ignitor to ignite 418 the gas. The microprocessor checks 430 the flame ionization sensor system to confirm that the flame is lit. During this mode, the modulating actuator continues 442 to modulate the gas pressure to modulate the thermal output from the gas burner. This controls the rate of heating. The temperature sensor reports 444 the temperature to the microprocessor, which then signals 446 the wireless link to communicate 448 the temperature to the user's mobile device or alternatively sends a wired message to the desktop. The mobile device reports 450 the temperature to the user, who then decides 452 to change the heating source to electricity. Alternatively, the user simply decides to change the heating source without receiving any temperature information. The gas burner is shut off by the microprocessor signaling 454 the modulating actuator, which then closes 456 the valve. The microprocessor then signals 458 the on off switch to switch on 460. The electrical element begins heating 462.

The temperature sensor continually reports 470 the temperature to the microprocessor which then signals 472 the on off switch to switch 474 thus maintaining 478 the temperature or allowing 480 the temperature to increase at a preselected rate or at a rate which the user has instructed 482. The user then decides to use the dual heating mode. The user may, for example, instruct 484 their mobile device, which then sends 486 a wireless message to the wireless link of the microprocessor. The microprocessor signals 488 the modulating actuator to open 490 the valve to start the flow of gas and the ignitor to ignite 492 the gas. The flame ionization sensor system signals 494 the microprocessor to confirm that the flame is lit. During this mode, the modulating actuator continues 496 to modulate the gas pressure to modulate the thermal output from the gas burner. This controls the rate of heating. The temperature sensor reports 498 the temperature to the microprocessor, which then signals 500 the wireless link to communicate 502 the temperature to the user's mobile device. In the dual heating mode 340 the temperature sensor continually reports 504 the temperature to the microprocessor which then signals 506 the on off switch to switch 508. The microprocessor also signals 510 the modulating actuator which modulates 512 the gas pressure. Both modulate 514 the thermal output thus maintaining 516 the temperature at a plus or minus 1° C.

Figure 11:
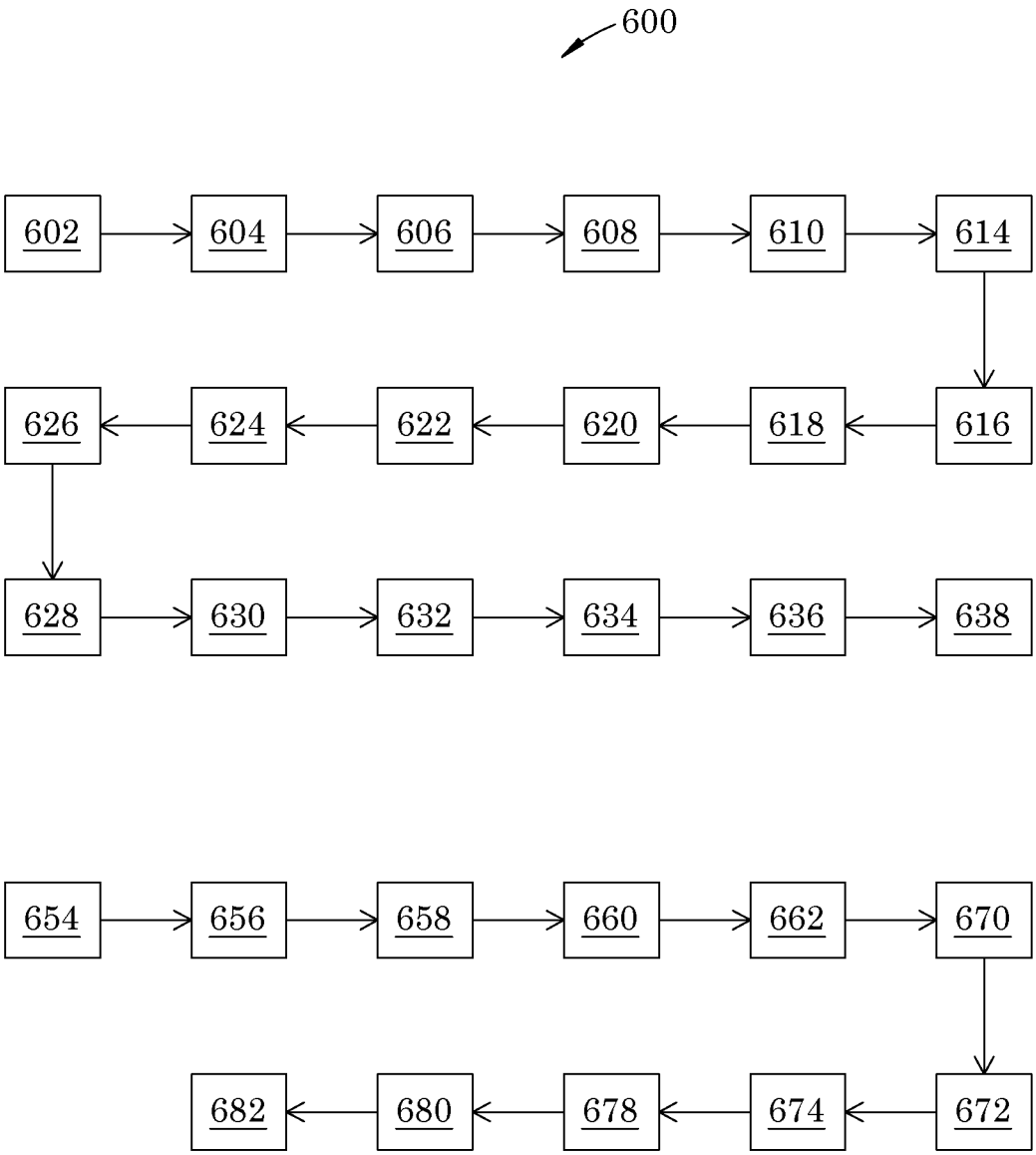
FIG. 11 is a block diagram of a user-controlled operation of the fireplace of FIG. 1.

As shown in FIG. 11, a third method of operating the hybrid fireplace is a user-controlled operation, generally referred to as 600. In this, the utilities communicate 602 through a wireless communication link to the user's mobile device or a wired communication link to another computing device to indicate the most cost-effective heating mode (gas only, electricity only, both in equal or different amounts). Based on this information, the user selects 604 the temperature and selects 606 the heat source. The user may, for example, instruct 608 their mobile device, which then sends 610 a wireless message to the wireless link of the microprocessor to heat using gas or may use a wired link from their desktop. The microprocessor signals 614 the modulating actuator to open 616 the valve to start the flow of gas and the ignitor to ignite 618 the gas. The microprocessor checks 620 the flame ionization sensor system to confirm that the flame is lit. During this mode, the modulating actuator continues 622 to modulate the gas pressure to modulate the thermal output from the gas burner. This controls the rate of heating. The temperature sensor reports 624 the temperature to the microprocessor, which then signals 626 the wireless link to communicate 628 the temperature to the user's mobile device or the wired link to communicate with their desktop. The mobile device reports 630 the temperature to the user. The microprocessor continues to signal 632 the modulating actuator which modulates 634 the gas pressure. This modulates 636 the thermal output thus maintaining 638 the temperature at a plus or minus 1° C.

Alternatively, the user instructs 654 their mobile device, which then sends 656 a wireless message to the wireless link of the microprocessor (or a wired message) to heat using electricity. The microprocessor signals 658 the on off switch to switch on 660. The electrical element begins heating 662. The temperature sensor continually reports 670 the temperature to the microprocessor which then signals 672 the on off switch to switch 674 rapidly, thus maintaining 678 the temperature at a plus or minus 1° C. or allowing 680 the temperature to increase at a preselected rate or at a rate which the user has instructed 682.

Figure 12:
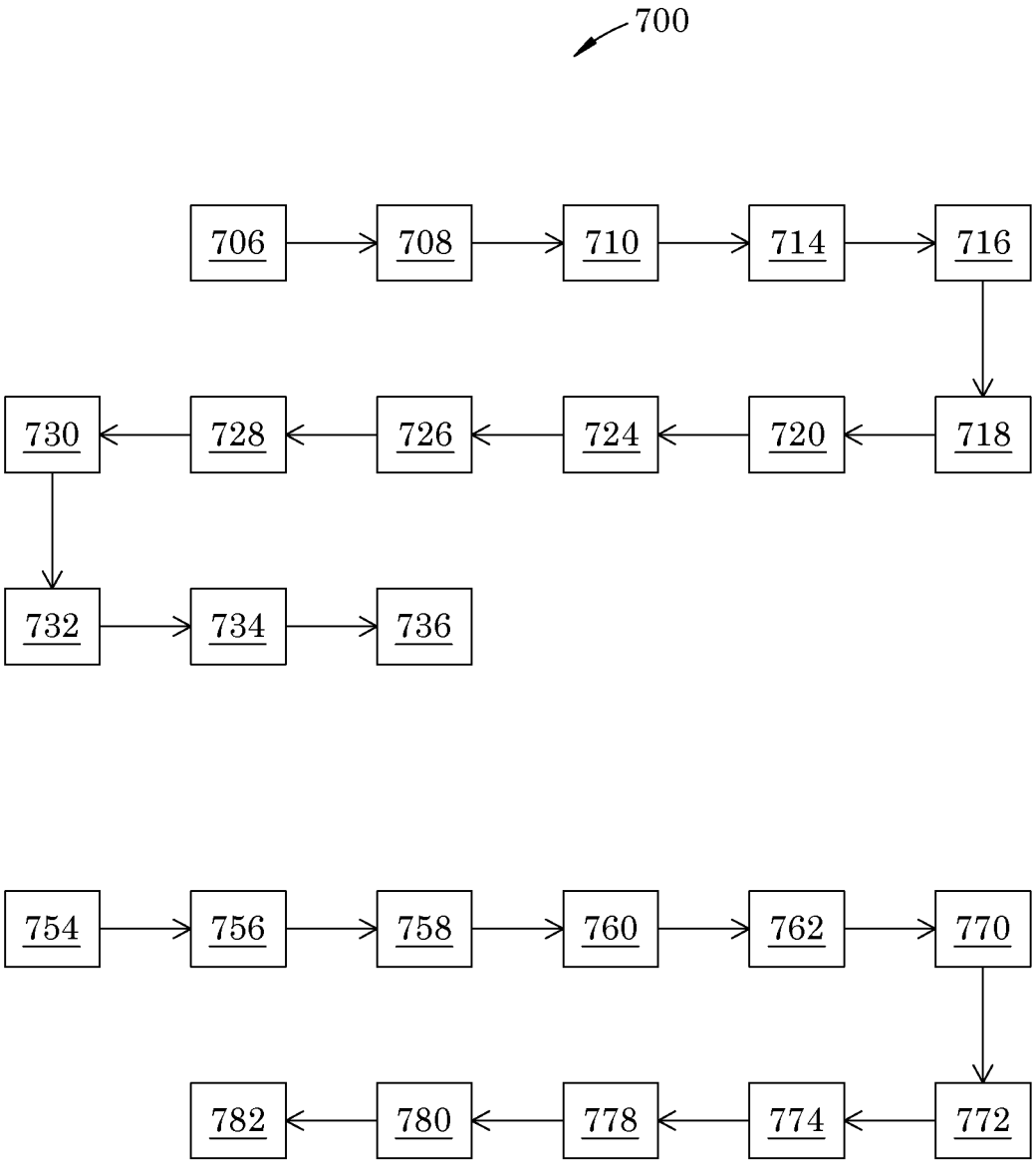
FIG. 12 is a block diagram of a utilities-controlled operation of the fireplace of FIG. 1.

As shown in FIG. 12, a fourth method of operating the hybrid fireplace is a utility-controlled operation, generally referred to as 700. The utility selects 706 the heat source. The utility may, for example, instruct 708 their computing device, which then sends 710 a wireless message to the wireless link (or a wired message with a wired link) of the microprocessor to heat using gas. The microprocessor signals 714 the modulating actuator to open 716 the valve to start the flow of gas and the ignitor to ignite 718 the gas. The microprocessor checks 720 the flame ionization sensor system to confirm that the flame is lit. During this mode, the modulating actuator continues 722 to modulate the gas pressure to modulate the thermal output from the gas burner. This controls the rate of heating. The temperature sensor reports 724 the temperature to the microprocessor, which optionally then signals 726 the wireless link (or wired link) to communicate 728 the temperature to the utility's computing device. The microprocessor continues to signal 730 the modulating actuator which modulates 732 the gas pressure. This modulates 734 the thermal output thus maintaining 736 the temperature at a plus or minus 1° C.

Alternatively, the utility instructs 754 their computing device, which then sends 756 a wired or wireless message to the wired or wireless link of the microprocessor to heat using electricity. The microprocessor signals 758 the on off switch to switch on 760. The electrical element begins heating 762. The temperature sensor continually reports 770 the temperature to the microprocessor which then signals 772 the on off switch to switch 774, thus maintaining 778 the temperature or allowing 780 the temperature to increase at a preselected rate or at a rate which the utility has instructed 782.

Figure 13:
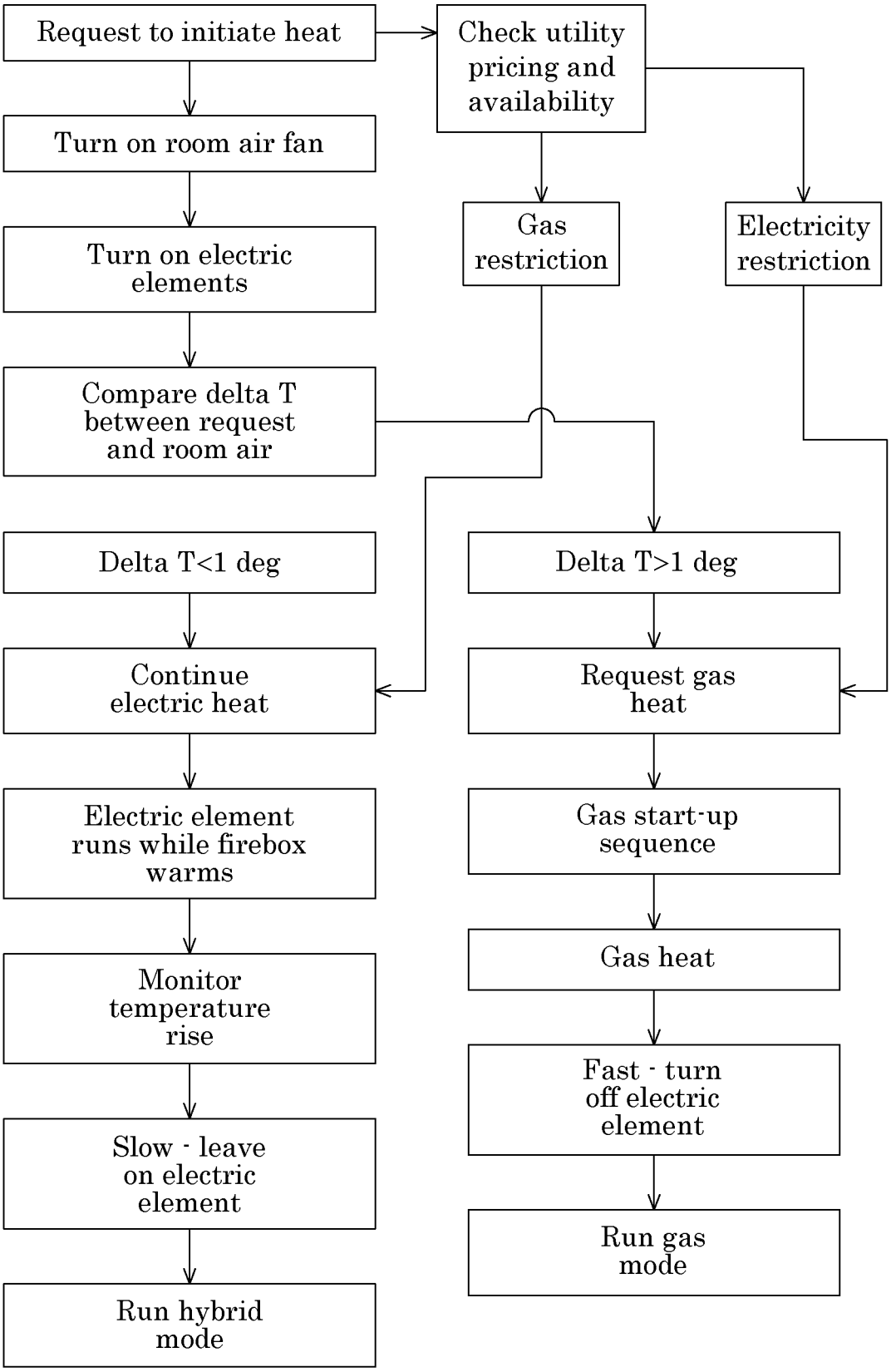
FIG. 13 is a block diagram of the decision-making process for operating the fireplace of FIG. 1.

FIG. 13 shows the decision-making process at start up leading to operation in the hybrid mode and in the gas only mode. In one embodiment, the decisions are made by the user. In another embodiment, the decisions are made locally, under control of a computing device in or proximate the user's residence. In another embodiment, the decisions are made remotely, under control of a computing device in a utility.

The sources of request for heat are as follows:

Autonomous—some form of thermostat/temperature sensor requesting heat; Programmed thermostat device and schedule;

Human—remote request through an application (back in town, warm up the house);

Human—walk into room and manually adjust the temperature with the thermostat;

Human—turn on the gas burner for heat—efficiency mode;

Human—turn on the gas burner for aesthetics—decorative mode;

Human—turn on the gas and/or the electric burner for heat—best fuel pricing/availability;

Utility—change energy source while running;

Utility—has excess energy and uses the fireplace or room the fireplace is in to store the energy;

Monitoring has shown the need to run de-icing program;

Monitoring has shown the need for a burn-off cleaning cycle; and

Extended temperature setpoint delta mode. This allows the utility to widen the temperature rise delta towards the end of the source usage interval (i.e. switching to gas from electricity). This allows for extra electrically supplied BTUs to be introduced into the space in order to delay the need to switch back to gas heating in short order. If the switch is to electricity from gas, then this allows for extra gas supplied BTUs to be introduced into the space in order to delay the need to switch back to electrical heating in short order. Essentially, this uses the heated space as a thermal battery without adversely affecting the room temperature (i.e. no more than about 2 degrees Celsius).

While example embodiments have been described in connection with what is presently considered to be an example of a possible most practical and/or suitable embodiment, it is to be understood that the descriptions are not to be limited to the disclosed embodiments, but on the contrary, is intended to cover various modifications and equivalent arrangements included within the spirit and scope of the example embodiment. Those skilled in the art will recognize or be able to ascertain using no more than routine experimentation, many equivalents to the specific example embodiments specifically described herein. Such equivalents are intended to be encompassed in the scope of the claims, if appended hereto or subsequently filed.

The invention claimed is:

1. A non-industrial hybrid heater apparatus for use with a gas supply and an electricity supply to provide a temperature controlled environment, the hybrid heater-comprising:

a firebox, which includes a top, a bottom, a back, a pair of sides, a front, an exhaust flue, a gas burner housed in the firebox and providing a first heat source, a variable pressure gas valve in fluid communication with the gas burner, a modulating actuator in mechanical communication with the variable pressure gas valve, a housing attached to the firebox, the housing including a top, a bottom, a back, a pair of sides, an ambient air inlet proximate the top, an ambient air outlet proximate the bottom, a first ambient air channel in fluid communication with the ambient air inlet, a second ambient air channel; a fan between the first ambient air channel and the second ambient air channel, the second ambient air channel in fluid communication with the first ambient air channel via the fan; a heat exchanger housed in the housing proximate the top of the firebox and in fluid communication with the second ambient air channel; a third ambient air channel in fluid communication with the heat exchanger and the ambient air outlet; an electric element housed in the housing downstream from the heat exchanger, the electric element providing a second heat source; a high duty cycle on off switch in electrical communication with the electric element, wherein the high duty cycle on off switch is configured to switch at between 30 times and 10,000 times per second; a printed circuit board which is in electronic communication with both the modulating actuator and the high duty cycle on off switch; and a microprocessor which is in electronic communication with the printed circuit board, wherein the microprocessor is configured to modulate the first heat source and the second heat source based on parameters including two or more of a selected rate of heating, a current system load, a cost of a heat source and an availability of the heat source.

2. The non-industrial hybrid heater apparatus of claim 1, wherein the microprocessor is configured to switch the first heat source on and off, switch the second heat source on and off and adjust an output of each of the first heat source and the second heat source.

3. The non-industrial hybrid heater apparatus of claim 2, wherein the microprocessor is configured to maintain the target temperature at plus or minus 1° C. or the selected rate of heating at plus or minus 1° C. of a selected temperature at a selected time.

4. The non-industrial hybrid heater apparatus of claim 3, wherein the non-industrial hybrid apparatus is a gas fireplace with the electric element.

5. A method of heating a domestic space, the method comprising:

a user selecting the non-industrial hybrid heater apparatus of claim 1;

the user selecting a target temperature; and the microprocessor modulating the first heat source and the second heat source based on parameters including two or more of a selected rate of heating, a current system load, a cost of a heat source and an availability of the heat source by adjusting the gas flow and the electric current flow.

6. The method of claim 5, further comprising the user selecting a rate of heating.

7. The method of claim 5, further comprising the microprocessor, in any order and in any number of times, switching the first heat source on and off, switching the second heat source on and off and adjusting an output of each of the first heat source and the second heat source.

8. The method of claim 7, further comprising the microprocessor communicating with a remote computing device.

9. The method of claim 8, further comprising the remote computing device instructing the microprocessor to modulate the first heat source and the second heat source based on parameters including two or more of, the selected rate of heating, the current system load, the cost of a heat source and the availability of the heat source.

10. The method of claim 8, further comprising the remote computing device determining a cost-effective heating mode and instructing the microprocessor, the microprocessor adjusting the gas flow and the electric current flow such that the gas fire heater and the electric element are operating in the cost-effective heating mode.

11. A non-industrial hybrid heating system for use with a gas supply and an electricity supply to provide a temperature controlled environment, the hybrid heating system comprising: a residential hybrid heater, the residential hybrid heater including a firebox, which includes a top, a bottom, a back, a pair of sides, a front, a gas burner housed in the firebox and providing a first heat source, a variable pressure gas valve in fluid communication with the gas burner, a modulating actuator in mechanical communication with the variable pressure gas valve, a housing attached to the firebox, the housing including a top, a bottom, a back, a pair of sides, an ambient air inlet, an ambient air outlet, a first safety barrier and a second safety barrier, the first safety barrier and the second safety barrier defining a first interstitial space and the second safety barrier and the front defining a second interstitial space, a fan mounted between the first interstitial space and the second interstitial space, the first interstitial space in fluid communication with the ambient air intake and the second interstitial space via the fan, a heat exchanger housed in the housing and located proximate the top of the firebox, a refractory chamber defined by the back of the firebox and the back of the housing, an air flow path extending sequentially from the air intake through the first interstitial space, the second interstitial space, the heat exchanger, the refractory chamber and the ambient air outlet, an electric element housed in the housing downstream from the heat exchanger, the electric element providing a second heat source, a high duty cycle on off switch in electrical communication with the electric element, a printed circuit board which is in electronic communication with both the modulating actuator and the high duty cycle on off switch, and a microprocessor which is in electronic communication with the printed circuit board, wherein the high duty cycle on off switch is configured to switch at between 30 times and 10,000 times per second; and a computing device which includes a wired link or a wireless link to the microprocessor and is remote to the residential hybrid heater, wherein the computing device includes a memory and a processor, the memory configured to instruct the processor to instruct the microprocessor to modulate the first heat source and the second heat source based on parameters including two or more of, the selected rate of heating, the current system load, the cost of a heat source and the availability of the heat source.

12. The non-industrial hybrid heating system of claim 11, wherein the computing device is a personal computing device.

13. The non-industrial hybrid heating system of claim 11, wherein the computing device is a utilities company computing device.

14. The non-industrial hybrid heating system of claim 11, wherein the computing device is a third-party systems management company computing device.

15. The non-industrial hybrid heating system of claim 12, further comprising a utilities company computing device, which includes a wired link or a wireless link for communication with the personal computing device.

16. The non-industrial hybrid heating system of claim 12, further comprising a third-party systems management company computing device, which includes a wired link or a wireless link for communication with the personal computing device.

17. The non-industrial hybrid heating system of claim 16, wherein the third-party systems management company computing device includes a memory and a processor, the memory configured to instruct the processor to determine a cost-effective heating mode and to inform the personal computing device of the cost-effective heating mode.

* * * * *